US010858861B2

(12) United States Patent
Kondi et al.

(10) Patent No.: US 10,858,861 B2
(45) Date of Patent: Dec. 8, 2020

(54) ADJUSTABLE DEAD-LATCHING BOLT MECHANISM

(71) Applicant: Schlage Lock Company LLC, Carmel, IN (US)

(72) Inventors: Sushanth Anand Rao Kondi, Bangalore (IN); Mohammed Maksood Ali, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 92 days.

(21) Appl. No.: 16/155,481

(22) Filed: Oct. 9, 2018

(65) Prior Publication Data

US 2019/0040652 A1 Feb. 7, 2019

Related U.S. Application Data

(63) Continuation of application No. 14/791,765, filed on Jul. 6, 2015, now Pat. No. 10,094,142.

(60) Provisional application No. 62/020,793, filed on Jul. 3, 2014.

(51) Int. Cl.

| | |
|---|---|
| ***E05B 65/10*** | (2006.01) |
| ***E05B 17/20*** | (2006.01) |
| ***E05B 53/00*** | (2006.01) |
| ***E05B 63/06*** | (2006.01) |
| ***E05C 9/18*** | (2006.01) |

(52) U.S. Cl.

CPC ..... *E05B 17/2053* (2013.01); *E05B 53/003* (2013.01); *E05B 63/06* (2013.01); *E05B 65/1006* (2013.01); *E05C 9/185* (2013.01)

(58) Field of Classification Search

None

See application file for complete search history.

(56) References Cited

U.S. PATENT DOCUMENTS

| | | | |
|---|---|---|---|
| 2,887,336 | A | 5/1959 | Meyer |
| 3,563,585 | A | 2/1971 | Welch |
| 3,600,022 | A | 8/1971 | Armstrong |
| 4,315,648 | A | 2/1982 | Labelle |
| 4,601,499 | A | 7/1986 | Kim |
| 5,042,851 | A | 8/1991 | Hunt |
| 5,154,454 | A | 10/1992 | Hollaway |
| 5,702,134 | A | 12/1997 | Hsieh |
| 6,409,231 | B1 | 6/2002 | Rusiana |
| 7,287,784 | B2 | 10/2007 | Lin |
| 8,267,440 | B2 | 9/2012 | Shen |
| 2010/0066102 | A1 | 3/2010 | Shen |

(Continued)

*Primary Examiner* — Alyson M Merlino

(74) *Attorney, Agent, or Firm* — Taft Stettinius & Hollister LLP

(57) ABSTRACT

A latch mechanism having an adjustment mechanism that adjusts the distance to which a latch bolt extends into a mating recess. The adjustment mechanism may include a driver component and a driven component. Rotation of the driver component about a first axis may displace the driven component, thereby causing the position of the latch bolt to be adjusted along a second axis that is non-parallel to the first axis. According to certain embodiments, the first axis is perpendicular to the second axis. The latch mechanism may also include an inner housing that is displaced as the latch bolt is extended into, and retracted from, a mating recess in an adjacent structure. Further, the position of the inner housing may remain generally static as the position of the latch bolt is adjusted along the second axis via operation of the adjustment mechanism.

20 Claims, 8 Drawing Sheets

(56) References Cited

U.S. PATENT DOCUMENTS

| | | | |
|---|---|---|---|
| 2013/0154283 | A1 | 6/2013 | Arlinghaus et al. |
| 2014/0132009 | A1 | 5/2014 | Chiang et al. |

ADJUSTABLE DEAD-LATCHING BOLT MECHANISM

CROSS-REFERENCE TO RELATED APPLICATIONS

The present application is a continuation of U.S. patent application Ser. No. 14/791,765 filed Jul. 6, 2015 and issued as U.S. Pat. No. 10,094,142, which claims the benefit of U.S. Provisional Patent Application No. 62/020,793 filed Jul. 3, 2014, the contents of each application hereby incorporated by reference in their entirety.

BACKGROUND

Exit devices, including vertical rod exit devices, often have a latch device that extends into, and out of, the top and bottom edges of a door. Typically, the latch device is configured to extend away from the door and into a mating recess in a door frame so as to provide a locking engagement that may maintain the door in a closed position. The latch device may also be connected to a push bar or trim by a rod or cable. When the door is to be displaced, the push bar or trim is displaced, which may cause the rod or cable to provide a pushing or pulling force that retracts the latch device from the mating recess in the adjacent structure.

Operation of exit devices often requires that the latch device extend a sufficient distance into the mating recess so that the latch device attains a locked position within the mating recess. The extent to which the latch device is to operably extend away from the door and into a mating recess may differ for different doors and/or different door frames. For example, differences in door heights and/or the depths of mating recesses may alter the distance that the latch device is to extend into the mating recess to reach the locked position. Further, over time, the position of the door relative to the door frame may change. Such changes, which may be due, for example, to door sag and general wear and tear on the door, may also alter the degree to which the latch device is to extend into the mating recess.

The door installer often determines the extended position of the latch device before the door is installed, such as, for example, before the door is hung to the door frame. Thus, for ease of installation, the degree to which the latch device will at least initially extend away from the door is typically initially set while the door is laying in a horizontal orientation. Yet, the actual degree of the extension of the latch device typically is not known until after the door has been hung to the door frame. Further, for at least one type of latch device, the extent to which the latch device extends from the door is at least initially positioned by inserting a pin through one of a plurality of holes in a housing that is mounted to the door, and into a hole of the latch device. Such positioning of the pin often involves the installer trying to feel whether the pin has passed through one of the holes of the housing and into the hole of the latch device. When the degree of extension of the latch device is to be adjusted, the pin is removed from the hole of the latch device and the hole of the housing, and placed, again by feel, into another hole in the housing before being reinserted into the hole of the pin. Thus, the degree that the latch device may be adjusted or trimmed is generally limited to the number and positioning of the holes in the housing.

Further, such adjustments to the degree that the latch device extends from the door generally occur along the same axis as the latch device travels into and out of the mating recess. Yet, reliance on the same axis for these adjustments may preclude the latch device from providing dead-latching capabilities. Further, the absence of dead-latching capabilities may increase the opportunity for unauthorized displacement of the latch device and the resulting unauthorized unlocking of the exit device and/or displacement of the associated door to an open position. For example, the absence of dead-locking capabilities may allow for the latch device to be forcibly retracted by an item, such as, for example, by tools, fingers, or cards, among other items, that engages the latch device through a door gap.

BRIEF SUMMARY

An aspect of the present invention is a latch mechanism for securing a position of a door. The latch mechanism may include an outer housing having a sidewall that generally defines an inner region, the outer housing being configured for operable attachment to the door. The latch mechanism also includes a latch bolt that is operably connected to a displacement rod, the latch bolt having a distal end. Further, the distal end is at a first position when the latch bolt is in an extended position, and at a second position when the latch bolt is in a retracted position, the first position being further from the outer housing than the second position. The latch mechanism also includes an adjustment mechanism that includes a driver component and a driven component, the driven component being operably connected to the body portion of the displacement rod. The driver component is configured for rotational displacement about a first axis. Additionally, the driven component is adapted to be displaced by the rotational displacement of the driver component to adjust a position of the displacement rod and the latch bolt along a second axis, the second axis being non-parallel to the first axis.

Another aspect of the present invention is a latch mechanism for a door, the latch mechanism including an outer housing having a sidewall, the sidewall generally defining an inner region. The latch mechanism also includes an inner housing that is configured for slidable displacement within at least a portion of the inner region and an adjustment mechanism that is operably secured to the inner housing. The adjustment mechanism has a driver component and a driven component, at least a portion of the driven component is configured for a mating engagement with at least a portion of the driven component. Further, the driver component is adapted to be rotated about a first axis to displace the driven component. Additionally, the latch mechanism includes a displacement rod that has a first end, a second end, and a body portion, the body portion being adapted to operably engage the driven component. The displacement of the driven component by the rotation of the driver component displaces a position of the displacement rod along a second axis that is non-parallel to the first axis. The latch mechanism also includes a latch bolt that is operably connected to the first end of the displacement rod. The latch bolt is generally displaced along the second axis as the position of the displacement rod is adjusted by the displacement of the driven component.

Another aspect of the present invention is a latch mechanism for securing a door in a closed position relative to an adjacent structure, the latch mechanism having an outer housing that includes a sidewall that generally defines an inner region. The latch mechanism also includes an inner housing that is configured for slidable displacement between an extended position and a retracted position within at least a portion of the inner region. The inner housing also has an inner housing sidewall. Additionally, the latch mechanism includes an adjustment mechanism that has a driver component and a driven component, the driver component being operably connected to a drive shaft, at least a portion of the drive shaft being rotatably secured to the inner housing sidewall. The driver component may be configured to be rotatably displaced about a first axis, while the driven component is configured to be rotatably displaced about a second axis by the rotational displacement of the driver component, the first axis being perpendicular to the second axis. The latch mechanism also includes a displacement rod that has a first end, a second end, and a body portion. The first end is operably connected to a latch bolt. The body portion has an external thread that is configured for a mating engagement with an internal thread of the driven component. The rotational displacement of the internal thread about the external thread is adapted to adjust the position of the latch bolt generally along the second axis and between at least a first position and a second position. The latch bolt is configured to extend into a recess in the adjacent structure when the inner housing is in the extended position, and to be retracted from the recess when the inner housing is in the retracted position.

Other aspects of the present invention will become apparent by consideration of the detailed description and accompanying drawings.

Figure 1:
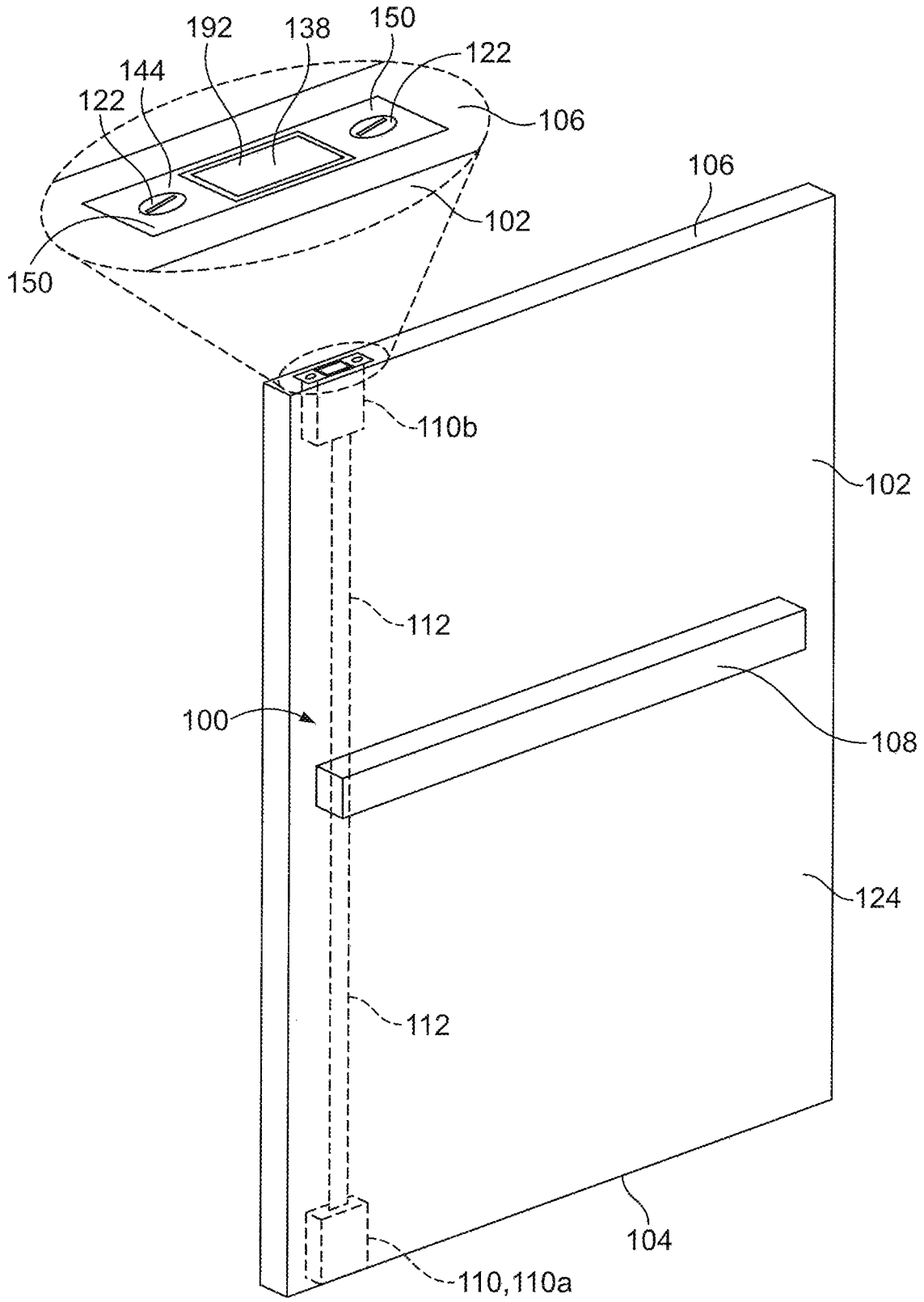
FIG. 1 illustrates a front view of an exit device that is attached to a door.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DESCRIPTION OF THE ILLUSTRATED EMBODIMENTS

FIG. 1 illustrates a front view of an exit device 100 that is attached to a door 102. The door 102 includes at least at least two edges at opposing sides of the door 102, such as, for example, a first edge 104 and a second edge 106. As shown, according to certain embodiments, the exit device 100 may include a push bar or trim 108 that is operably connected to at least one latch mechanism 110 by one or more rods or cables 112. In the illustrated embodiment, the exit device 100 includes a first latch mechanism 110*a* positioned at, or adjacent to, the first edge 104, and a second latch mechanism 110*b* positioned at, or adjacent to, the second edge 106. However, it is contemplated that the number, as well as the positioning of latch mechanisms 110, may vary for different doors or door configurations. For example, according to certain embodiments, the exit device 100 may include only a first latch mechanism 110*a* that is positioned along the first edge 104, with the first edge 104 corresponding to the top edge or the bottom edge of the door 102.

Figure 2A:
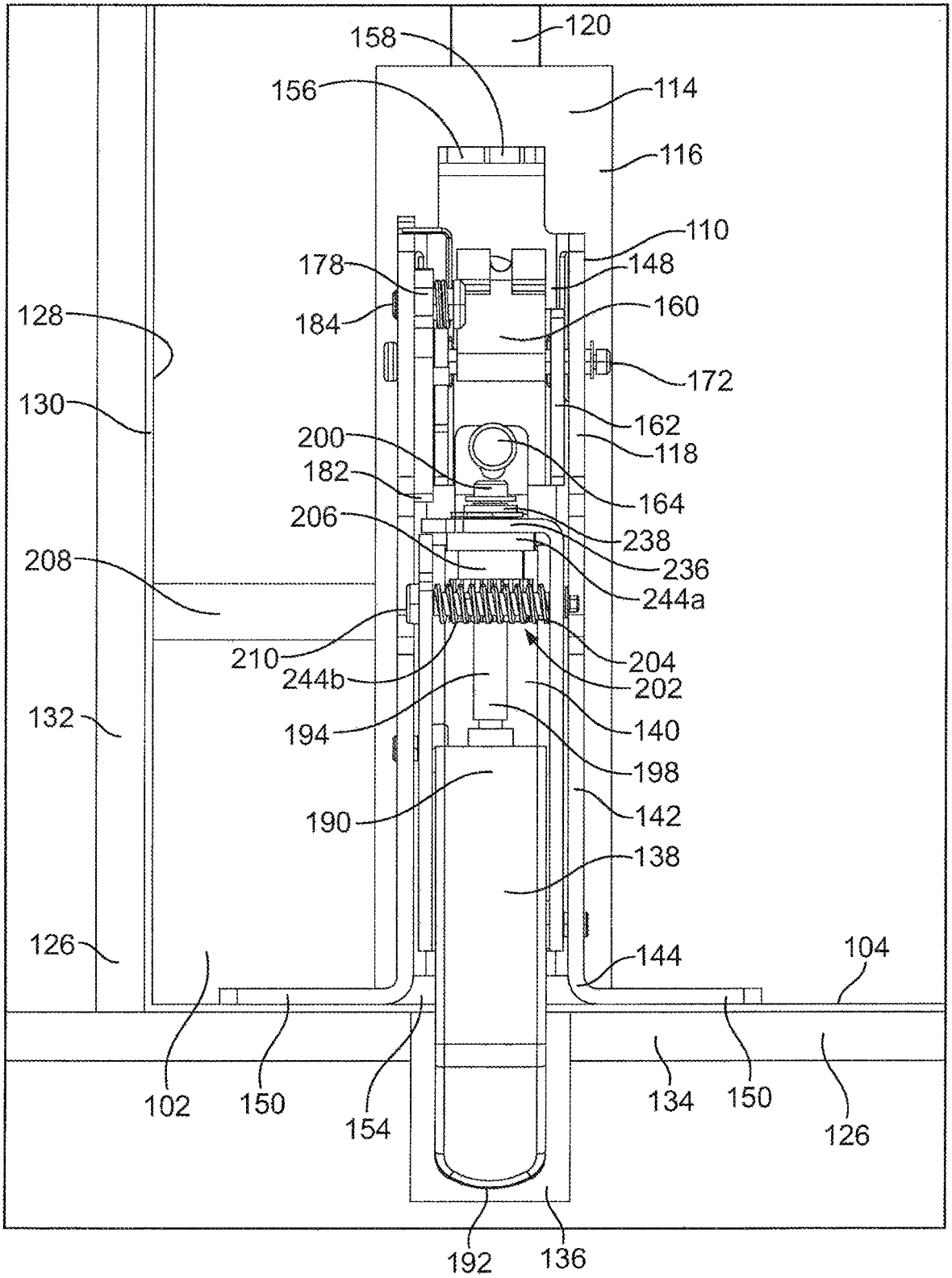
FIG. 2A illustrates a front cutaway view of a latch mechanism positioned in a cavity of a door and having a latch bolt that has been adjusted to a first position that is extended into a mating recess according to an illustrated embodiment of the present invention.
Figure 2B:
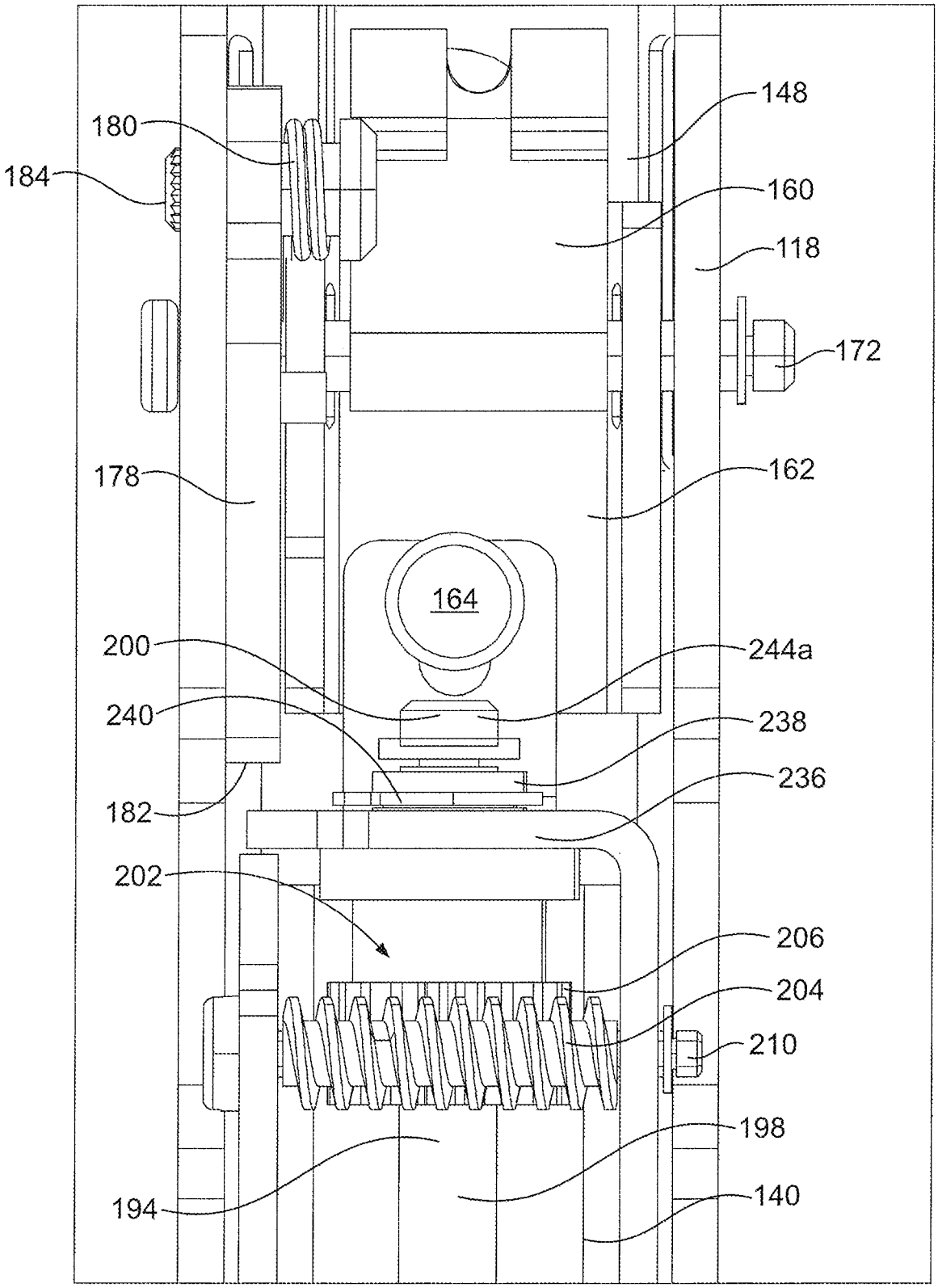
FIG. 2B illustrates an enlarge view of a portion of the latch mechanism shown in FIG. 2A.

FIGS. 2A and 2B illustrate a front cutaway view of a latch mechanism 110 positioned in a cavity 114 in the door 102. The cavity 114 may have a variety of different shapes and sizes. For example, according to certain embodiments, the cavity 114 may have a first portion 116 that is configured to receive at least a portion of the latch mechanism 110, such as, for example, an outer housing 118 of the latch mechanism 110, and a second portion 120 that is sized to receive placement of the rod or cable 112. Further, as shown in FIG. 1, according to certain embodiments, the latch mechanism 110 may be secured to the door 102 through the use of one or more fasteners 122, such as, for example, screws, bolts, or pins, among other fasteners. Alternatively, rather than being positioned within the door 102, according to other embodiments, the latch mechanism 110 and/or rod or cable 112 may be positioned along an outer, exterior surface 124 of the door 102.

As shown in FIGS. 1 and 2A, according to certain embodiments, at least when the door 102 is in a closed position, one or more edges of the door 102 may be in relatively close proximity to an adjacent surface or structure 126, such as, for example, a door frame, wall, or floor, among other surfaces or structures. For example, in the illustrated embodiment, with the door 102 in a closed position, a third edge 128 of the door 102 that is generally perpendicular to the first and second edges 104, 106, may be adjacent to a side portion 130 of a door frame 132, while the first edge 104 may be adjacent to a bottom portion 134 of the door frame 132. In the illustrated embodiment, the bottom portion 134 of the door frame 132 may include at least a portion of a recess 136 that is configured to receive the removable insertion of the latch bolt 138 from the first latch mechanism 110*a*. Similarly according to certain embodiments which include the second latch mechanism 110*b* in addition to, or in lieu of, the first latch mechanism 110*a*, a latch bolt 138 from the second latch mechanism 110*b* may extend away from the second edge 106 and into an adjacent recess positioned in at least an upper portion of the door frame 132 or an adjacent wall. Optionally, according to certain embodiments, in addition to, or in lieu of the first and/or second latch mechanisms 110*a*, 110*b*, the exit device 100 may include at least a third latch mechanism positioned at, or adjacent to, the third edge 128 of the door 102, and which extends into a recess in the side portion 130 of the door frame 132.

Figure 3:
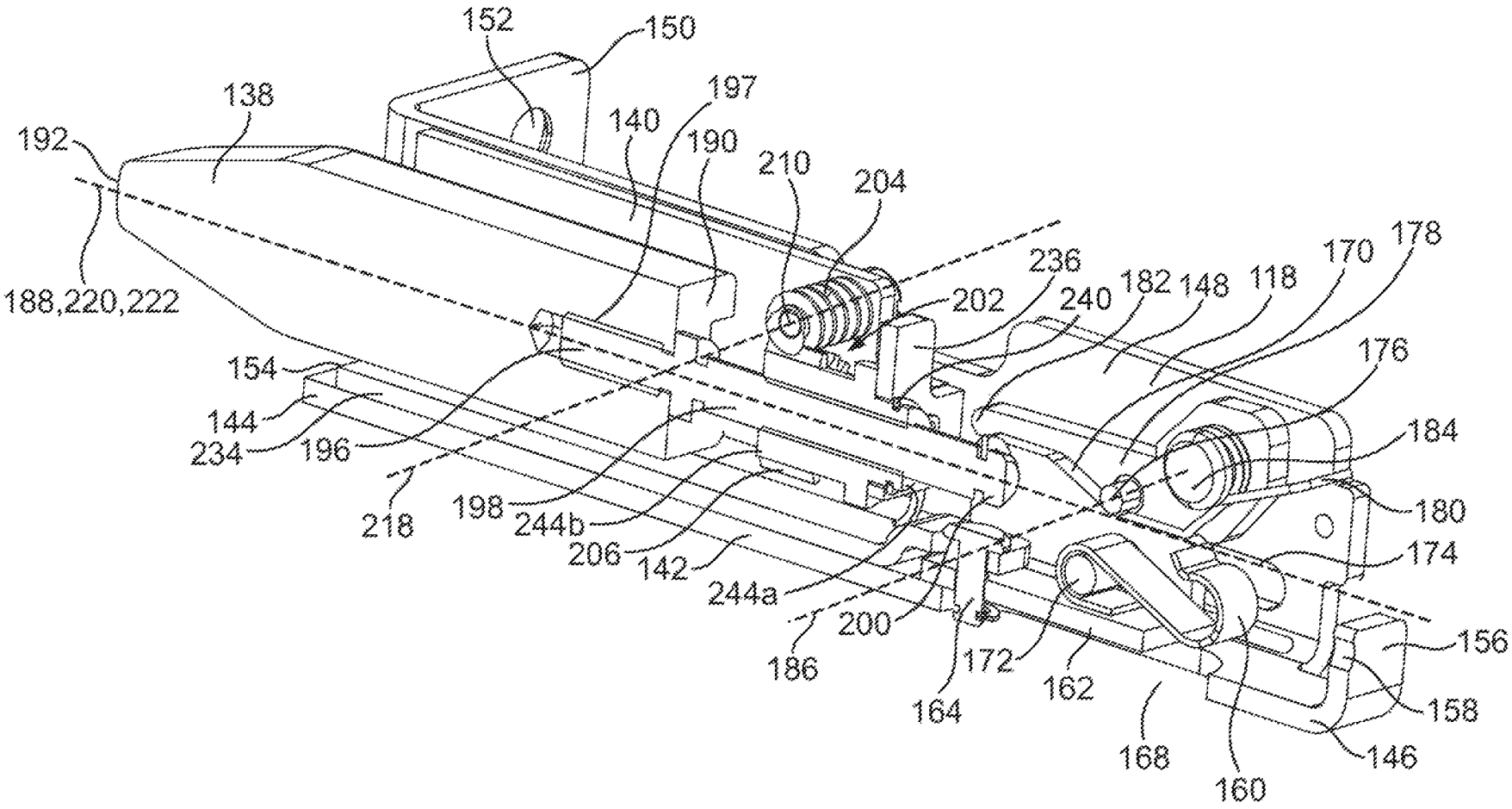
FIG. 3 illustrates a cutaway side perspective view of the latch mechanism shown in FIG. 2.

FIG. 3 illustrates a cutaway side perspective view of the latch mechanism 110 shown in FIG. 2A. As shown, the latch mechanism 110 includes the latch bolt 138, an inner housing 140, and the outer housing 118. The outer housing 118 may include a sidewall 142 that generally extends between a first end 144 and a second end 146 of the outer housing 118, and which generally defines an inner region 148 of the outer housing 118. The inner housing 140 may be configured for slidable displacement within at least a portion of the inner region 148 of the outer housing 118 as the latch bolt 138 is displaced between extended, or locked, and retracted, or unlocked, positions.

According to certain embodiments, the sidewall 142 of the outer housing 118 may be operably connected to one or more extensions 150 that are configured to extend about the first end 144 of the outer housing 118 and along an adjacent edge, or a recess in an edge, of the door 102, such as, for example, along the first edge 104 or a recess in the first edge 104. Further, the one or more extensions 150 may include an aperture 152 that is configured to receive the insertion of one or more fasteners 122 that secure the latch mechanism 110 to the door 102, as previously discussed. The first end 144 may also include an opening 154 that is configured to allow the slidable displacement of at least a portion of the latch bolt 138 into, and out of, at least the inner region 148 of the outer housing 118.

The second end 146 of the outer housing 118 may include a top wall 156 that is configured to at least provide a passageway 158 for a rod or cable 112 that is operably connected to a cable link 160. The cable link 160 may be operably connected to a drawbar link 162 that is positioned within the inner region 148 of the outer housing 118. For example, in the illustrated embodiment, the cable link 160 may be positioned about a link shaft 172 that extends through an opening in the drawbar link 162 and into a slot 174 in the outer housing 118. The engagement of the link shaft 172 within the slot 174 may at least assist in guiding the displacement of the cable link 160 and the drawbar link 162.

According to the illustrated embodiment, the inner housing 140 may also be operably connected to the drawbar link 162. For example, as shown at least in FIG. 3, according to the illustrated embodiment, a housing shaft 164 may extend between apertures in the inner housing 140 and the drawbar link 162, respectively, so as to connect the inner housing 140 to the drawbar link 162. Further, according to the illustrated embodiment, the outer housing 118 may include a slot 168 that is configured to accommodate the displacement of at least a portion of the housing shaft 164. The connection between the inner housing 140 and the drawbar link 162 may allow at least the inner housing 140 and the latch bolt 138 to be displaced with the displacement of the drawbar link 162, as discussed below.

In the illustrated embodiment, the drawbar link 162 includes an inclined surface 170 that is configured to engage a protrusion 176 of a deadlock link 178. When the protrusion 176 is at a first position relative to the inclined surface 170, as shown for example in FIG. 3, the deadlock link 178 is biased by a biasing element 180, such as, for example, a spring, to a locked position. As shown by at least FIGS. 2A, 3, and 5-7, when in the locked position, an abutment surface 182 of the deadlock link 178 is positioned to provide a barrier that prevents or otherwise limits the displacement of the inner housing 140 within the inner region 148 in a direction that may otherwise unlock the latch bolt 138 from a locking engagement with the recess 136. Thus, with the deadlock link 178 in the locked position, the latch bolt 138 may generally not be displaced to the recessed, or unlocked, position.

According to the illustrated embodiment, when the latch bolt 138 is to be displaced to a retracted or unlocked position, activation of the push bar or trim 108 may cause the rod or cable 112 to exert a pulling force on cable link 160 that causes the cable link 160 to be displaced generally toward the top wall 156. As the cable link 160 is operably connected to the drawbar link 162 by the link shaft 172, the drawbar link 162 is also displaced as the cable link 160 is displaced. Such displacement of the drawbar link 162 causes the inclined surface 170 of the drawbar link 162 to operably engage the protrusion 176 of the deadlock link 178. Moreover, as the drawbar link 162 is displaced, the moving engagement of the inclined surface 170 against the protrusion 176 of the deadlock link 178 provides sufficient force to overcome the biasing force of the biasing element 180 so that the protrusion 176 is pivotally lifted from the first position to a second position. Such displacement of the protrusion 176 to the second position causes the deadlock link 178 to pivot about the pivot post 184 to an unlocked position. As shown in at least FIG. 3, in the illustrated embodiment, the center of rotation of deadlock link 178 about a pivot post 184 is along a central pivot axis 186 that is generally perpendicular to the longitudinal axis 188 of the latch bolt 138.

Figure 8:
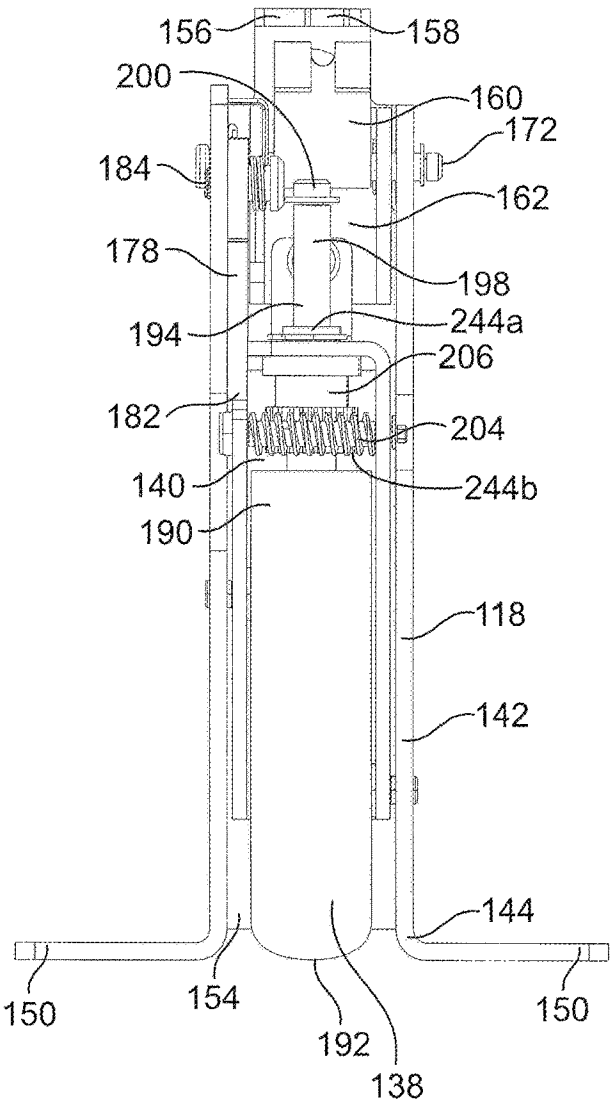
FIG. 8 illustrates a front view of a latch mechanism shown in FIG. 7 with the latch bolt and the inner housing in a retracted, or unlocked, position.
Figure 7:
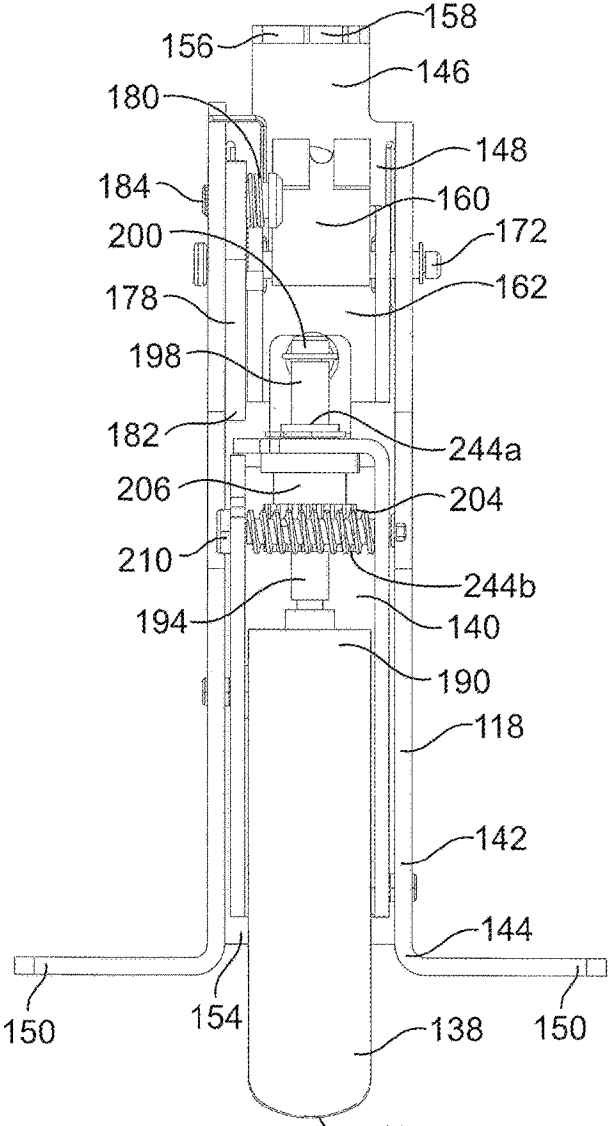
FIG. 7 illustrates a front view of a latch mechanism shown in FIG. 2A with the latch bolt in an intermediary position and the latch bolt and an inner housing in an extended, or locked, position.

With the deadlock link 178 pivotally displaced to an unlocked position, the abutment surface 182 of the deadlock link 178 is displaced to a position in which the abutment surface 182 does not prevent the inner housing 140, and thus the latch bolt 138, from being displaced to the recessed, or unlocked, position. Thus, as the rod or cable 112 exerts a pulling force that displaces the cable link 160 and drawbar link 162 generally toward the top wall 156, the connection between the drawbar link 162 and the inner housing 140 also allows at least the inner housing 140 and the latch bolt 138 to be displaced to the recessed, or unlocked, position, as shown, for example, in FIG. 8.

As shown by at least FIGS. 2A, 3 and 5-7, the latch bolt 138 has a proximal end 190 and a distal end 192. The distal end 192 of the latch bolt 138 is configured for removable insertion into the recess 136 of the bottom portion 134 of the door frame 132. According to certain embodiments, at least a portion of the distal end 192 may have a chamfered or rounded surface that may assist in the operable placement of the latch bolt 138 into the recess 136.

According to certain embodiments, the proximal end 190 of the latch bolt 138 may be operably connected to at least a first end 196 of a displacement rod 194. For example, according to certain embodiments, the first end 196 of the displacement rod 194 may be operably secured within an orifice 197 of the latch bolt 138, such as, for example, by a press fit, weld, set screw, or pin, among other connections. Further, although illustrated in FIG. 3 as being separate components, according to other embodiments, at least a portion of the latch bolt 138 and displacement rod 194 may be a unitary or monolithic structure.

The displacement rod 194 may include the first end 196, a body portion 198, and a second end 200. At least a portion of the body portion 198 is configured for operable engagement with an adjustment mechanism 202 so as to adjust the position of the displacement rod 194 relative to the adjustment mechanism 202 and/or the inner housing 140, and thereby adjust the position of the latch bolt 138 within at least the inner housing 140. According to certain embodiments, the adjustment mechanism 202 includes a driver component 204 and a driven component 206. Moreover, actuation of the driver component 204 may cause the displacement of the driven component 206, with the displacement of the driven component 206 being translated into the movement of the displacement rod 194, and thus the associated displacement of the latch bolt 138 relative to at least the inner housing 140 of the latch mechanism 110.

The driver component 204 may be actuated in a number of manners. For example, referencing FIG. 2A, the door 102 may be configured to include an opening 208 that is configured to permit operable access to the driver component 204, or a drive shaft 210 of the driver component 204, such as, for example, by a digit of a door installer or a tool, such as, for example, a screw driver or hex key, among other tools.

Figure 4A:
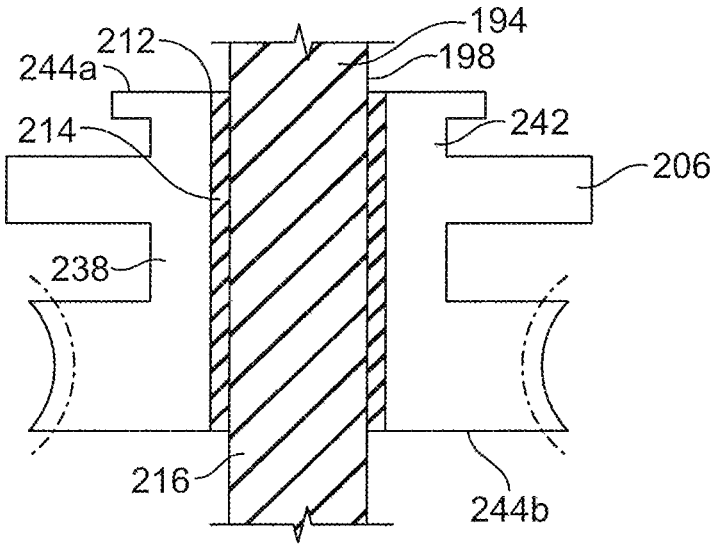
FIG. 4A is a cutaway side view of a driven component of an adjustment mechanism and a portion of a displacement rod according to an illustrated embodiment of the present invention.

In the illustrated embodiment, the driver component 204 is a threaded member, such as, for example, a screw or worm of a worm set, while the driven component 206 is a mating worm gear or wheel. As shown by FIG. 4A, according to such embodiment, the driven component 206 includes an aperture 212 having an internal thread 214 that engages an external thread 216 that is positioned along at least a portion of the body portion 198 of the displacement rod 194. The actuation of the driver component 204 along a driver axis 218 causes the rotation of the driven component 206 along a driven axis 220 that is offset from, and generally perpendicular to, the driver axis 218. Further, the rotation of the driven component 206 causes the internal thread 214 in the aperture 212 of the driven component 206 to also rotate relative to the external thread 216 of the body portion 198 of the displacement rod 194, thereby causing the displacement rod 194 to be displaced along a longitudinal axis 222 of the displacement rod 194. Referencing FIG. 3, in the illustrated embodiment, the longitudinal axes 188, 222 of the latch bolt 138 and the displacement rod 194, respectively, may be generally aligned with the driven axis 220. According to such embodiment, the direction of displacement of the latch bolt 138 may be dependent on the direction of rotation of the driven component 206 and the direction of the orientation of the internal thread of the aperture 212 of the driven component 206 and the mating external thread of the body portion 198 of the displacement rod 194.

Figure 4B:
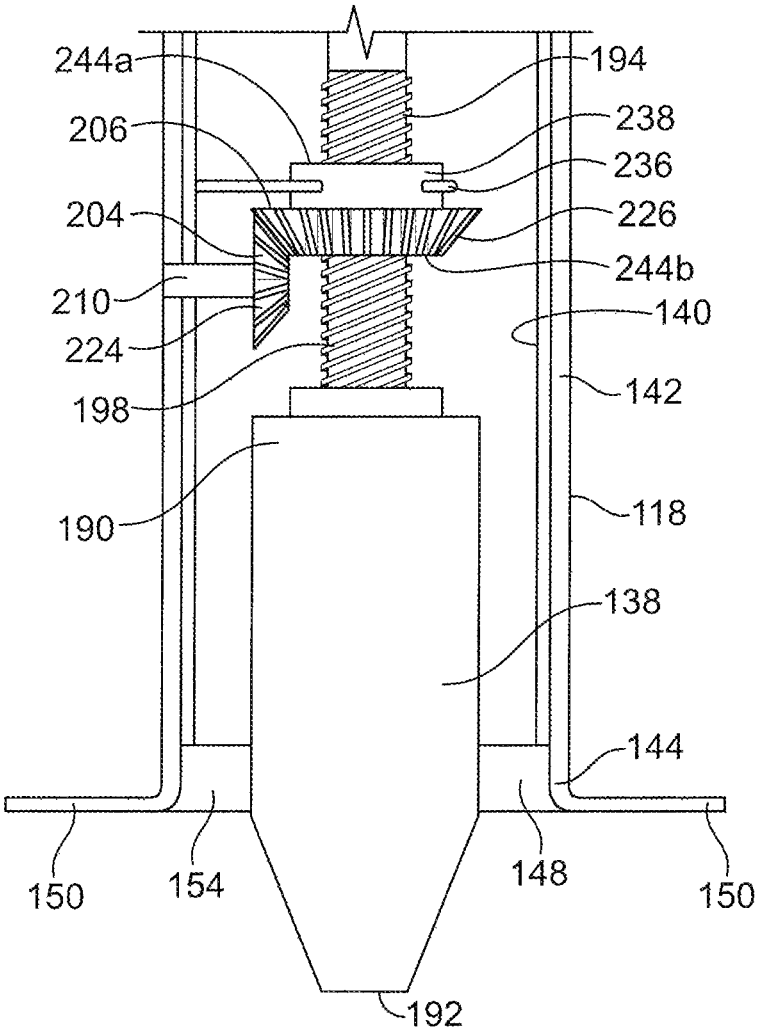
FIG. 4B illustrates a cutaway side perspective view of a portion of a latch mechanism having an adjustment mechanism that includes a pair of bevel gears according to an illustrated embodiment of the present invention.
Figure 4C:
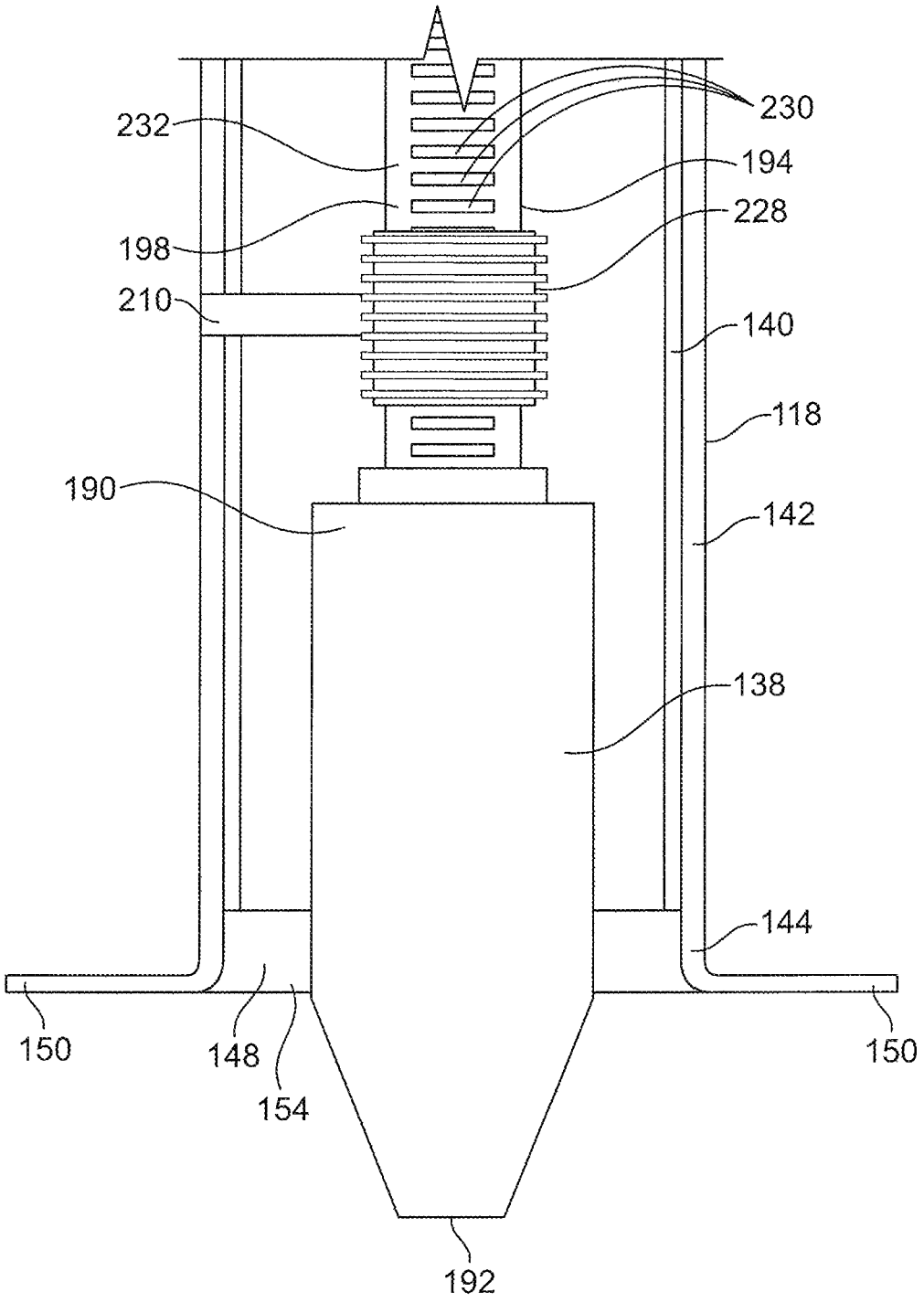
FIG. 4C illustrates a cutaway side perspective view of a portion of a latch mechanism having an adjustment mechanism that includes a pinion and a plurality of teeth or serrations along a side surface a displacement rod according to an illustrated embodiment of the present invention.

While the foregoing provides some examples of configurations of the adjustment mechanism 202, the adjustment mechanism 202 may have a variety of other, different configurations. For example, referencing FIG. 4B, according to certain embodiments, the driver and driven components 204, 206 may comprise mating first and second bevel gears 224, 226 that are oriented on non-parallel and intersecting axes. According to such an embodiment, a first bevel gear 224 may be the driver gear 218 that engages the second bevel gear 226. Further, the second bevel gear 226 may also include an aperture 212 having an internal thread 214 that is configured to engage the external thread 216 of the body portion 198 of the displacement rod 194 in a manner similar to that as previously discussed. Further, for example, referencing FIG. 4C, according to another embodiment the adjustment mechanism 202 includes a pinion 228 and a plurality or rack of teeth or serrations 230 along a side wall 232 of the body portion 198 of the displacement rod 194. According to such an embodiment, as the pinion 228 is rotated, the teeth or protrusions of the pinion 228 may sequentially engage the teeth or serrations 230 on the body portion 198, thereby causing the displacement rod 194, and thus the latch bolt 138, to be displaced in a direction that is at least generally aligned with the longitudinal axis 188 of the latch bolt 138.

The adjustment mechanism 202 may be operably connected to the inner housing 140. For example, referencing FIGS. 2 and 3, according to certain embodiments, the driver component 204 and the driven component 206 may be secured to, or include, a shaft, rod, or hub that is placed within an aperture in, or collar of, one or more sidewalls 234 of the inner housing 140. For example, as shown by at least FIG. 2 or 3, the driver component 204 may be operably connected to, or otherwise include, a drive shaft 210 that is rotated, as previously discussed, for example, by engagement with a digit or tool, and thereby also rotates the driver component 204. The driver component 204 may be operably secured to the drive shaft 210 in a number of different manners, including, for example, by a mating engagement of one or more non-round portions of the drive shaft 210 with one or more non-round portions of an orifice of the driver component 204, or through the use of a key and/or a set screw, among other engagements. As illustrated, the drive shaft 210 may at least partially extend through apertures in opposing first and second sidewalls of the inner housing 140, the apertures being configured to allow for the rotation of at least the shaft while also maintaining the positioning of the driver component 204 relative to the inner housing 140. Similarly, according to certain embodiments, the inner housing 140 may include an upper wall 236 that at least receives the rotatable placement of at least a portion of a hub portion 238 of the driven component 206 so as to allow for the rotation of the driven component 206 while maintaining the position of the driven component 206 relative to the inner housing 140. Additionally, according to certain embodiments, the position of the driven component 206 relative to the upper wall 236 of the inner housing 140 may be maintained by a clip or ring 240 that may operably engage a recessed area 242 of the hub portion 238, among other fasteners.

When the distance at which the latch bolt 138 extends away from at least the outer housing 118 and into a mating recess 136, and/or the extent to which the latch bolt 138 may be retracted into the outer housing 118, is to be adjusted, a tool may operably engage the driver component 204, as previously discussed. Rotational displacement of the tool, and the resulting rotation of the driver and driven components 204 may result in operable displacement of the displacement rod 194. For example referencing at least FIGS. 4A and 4B, rotational displacement of the driven component 206, and associated engagement of the threaded portions of the driven component 206 and the displacement rod 194, may adjust the length of the portion of the body portion 198 of the displacement rod 194 that is adjacent to a first side 244*a* of the driven component 206, and thereby also adjust the length of the portion of the body portion 198 that is adjacent to a second side 244*b* of the driven component 206. Similarly, referencing FIG. 4C, rotation of the driver component 204 may adjust the lengths of the body portion 198 of the displacement rod 194 that are adjacent to opposing sides 244*a*, 244*b* of the driven component 206. As the displacement rod 194 is operably connected to the latch bolt 138, such adjustment of the positioning of the displacement rod 194 may translate into an adjustment in the position of the latch bolt 138 at least generally along the longitudinal axis 188 of the latch bolt 138 and relative to the inner housing 140 and the adjustment mechanism 202.

Figure 6:
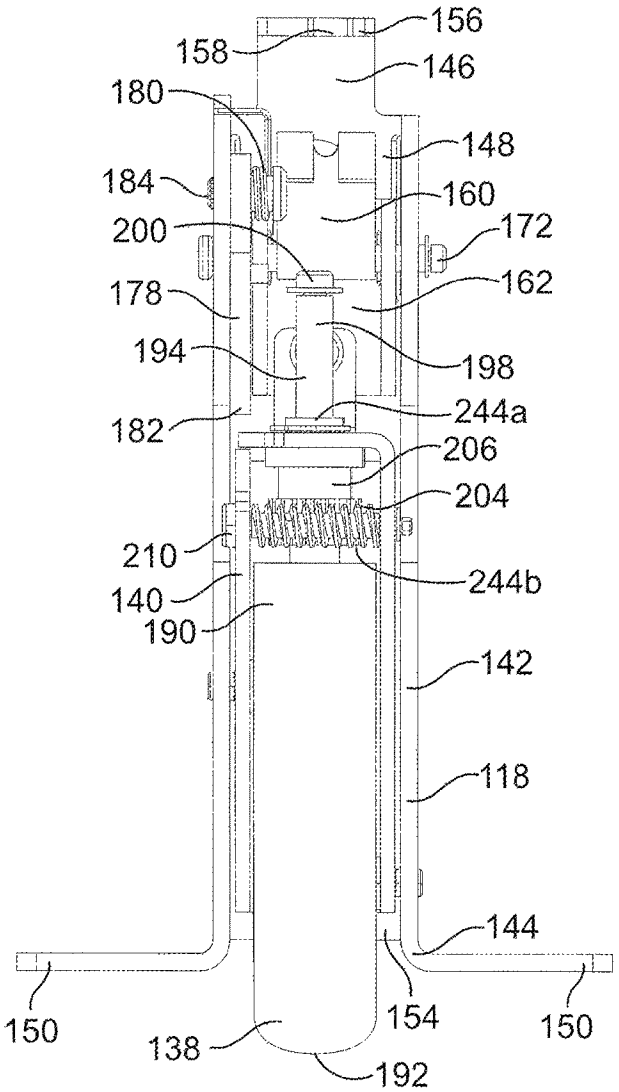
FIG. 6 illustrates a front view of a latch mechanism shown in FIG. 2A with the latch bolt adjusted to a second position.
Figure 5:
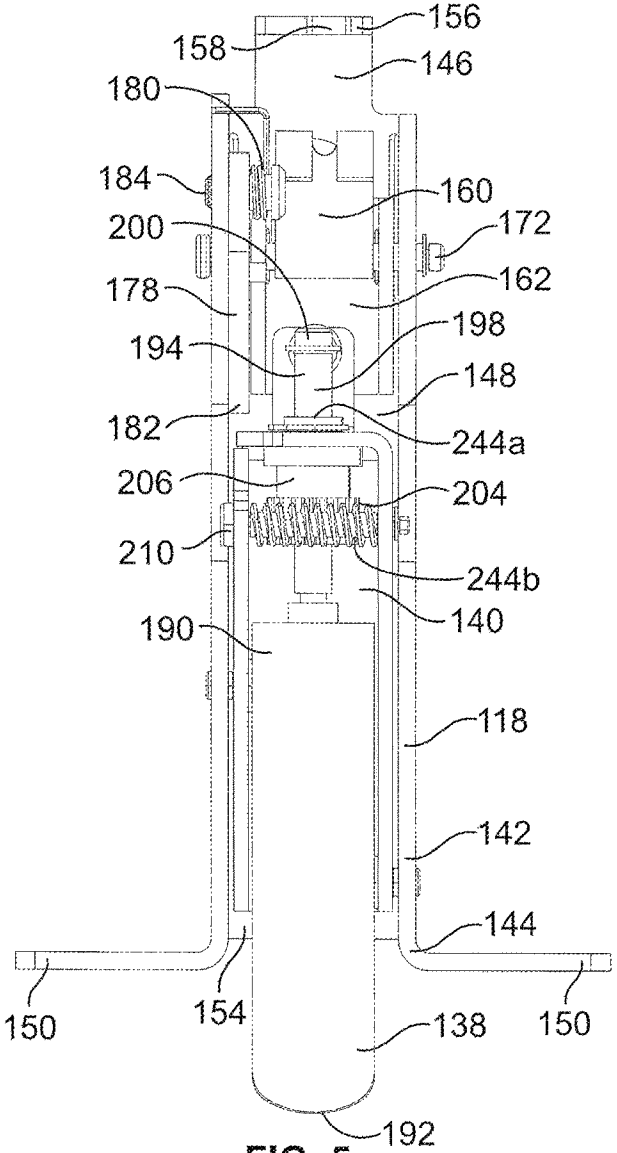
FIG. 5 illustrates a front view of a latch mechanism shown in FIG. 2A with the latch bolt adjusted to an intermediary position.

Such adjustments of the position of the displacement rod 194, and thus the latch bolt 138, may alter at least the distance that the distal end 192 of the latch bolt 138 may extend away from the edge of the door 102, and thus into the mating recess 136, when the latch bolt 138 is in the extended, or locked, position. For example, FIG. 2A illustrates the latch bolt 138 in a first position, wherein the distal end 192 of the latch bolt 138 may generally be extended a maximum distance from the edge 104 of the door 102 or into the mating recess 136. As shown, with the latch bolt 138 in the first position, the majority of the body portion 198 of the displacement rod 194 is adjacent to the second side 244*b* of the driven component 206. Conversely, FIG. 6 illustrates the latch bolt 138 in a second position, wherein the distal end 192 of the latch bolt 138 may generally be extended a minimum distance from the edge 104 of the door 102 or into the mating recess 136. As shown, with the latch bolt 138 in the second position, the length of the body portion 198 of the displacement rod that is adjacent to the second side 244*b* of the driven component 206 is substantially less than when the latch bolt 138 is adjusted to the first position. Further, the manner of engagement between the adjustment mechanism 202 and the displacement rod 194, such as, for example, the threaded engagement between the driven component 206 and the displacement rod 194 as discussed above with respect to FIGS. 4A and 4B, may also generally allow for the distal end 192 of the latch bolt 138 to be positioned at nearly, if not all, positions between the first and second positions, such as, for example, at the intermediately position shown in FIG. 5. Moreover, in the example shown by FIG. 5, generally equal lengths of portions of the body portion 198 of the displacement rod 194 are positioned adjacent to the opposing sides 244*a*, 244*b* of the driven component 206.

While the adjustment mechanism 202 may displaced the latch bolt 138 between the first and second positions, as well as positions there between, such adjustments may not alter the positioning of the inner housing 140 and at least the adjustment mechanism 202. For example, as shown in at, least FIGS. 2A, 5, and 6, as the position of the latch bolt 138 and the displacement rod 194 adjusted generally along the longitudinal axis of the latch bolt 138, the position of the inner housing 140 and the adjustment mechanism 202 generally remain static.

Various features and advantages of the present invention are set forth in the following claims. Additionally, changes and modifications to the described embodiments described herein will be apparent to those skilled in the art, and such changes and modifications can be made without departing from the spirit and scope of the present invention and without diminishing its intended advantages. While the present invention has been illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A latch mechanism, comprising:

an outer housing;

an inner housing mounted within the outer housing for movement along a longitudinal axis between a retracted position and an extended position;

a driver component mounted to the inner housing for rotation about a driver axis arranged perpendicular to the longitudinal axis;

a driven component mounted to the inner housing for rotation about the longitudinal axis, wherein the driven component is operably connected with the driver component such that rotation of the driver component about the driver axis causes a corresponding rotation of the driven component about the longitudinal axis, wherein the driven component comprises internal threads;

a displacement rod having a first end, a second end, and a body portion, wherein the body portion comprises external threads meshed with the internal threads of the driven component such that rotation of the driven component about the longitudinal axis causes a corresponding movement of the displacement rod along the longitudinal axis;

a bolt coupled to the first end of the displacement rod such that the bolt and the displacement rod are coupled for joint movement along the longitudinal axis when the driven component is rotated by the driver component, thereby adjusting a position of the bolt; and a deadlock link configured for displacement between a locked position and an unlocked position, the deadlock link including an abutment surface configured to prevent the movement of the inner housing from the extended position to the retracted position when the deadlock link is in the locked position.

2. The latch mechanism of claim 1, wherein the deadlock link is mounted for pivotal movement between the locked position and the unlocked position.

3. The latch mechanism of claim 1, further comprising a spring urging the deadlock link toward the locked position.

4. The latch mechanism of claim 1, further comprising a drawbar link connected to the inner housing, the drawbar link having an inclined surface configured to drive the deadlock link from the locked position to the unlocked position as the drawbar link moves in a retracting direction.

5. The latch mechanism of claim 1, wherein A position of the inner housing relative to the outer housing remains static as the position of the bolt is adjusted.

6. The latch mechanism of claim 5, wherein the driver component is a worm screw and the driven component is a worm gear intermeshed with the worm screw.

7. A latch mechanism for securing a position of a door, the latch mechanism comprising:

an outer housing configured for mounting to the door;

an inner housing slidably mounted in the outer housing for movement along a longitudinal axis between an extended position and a retracted position;

an adjustment mechanism, comprising:

a driver component mounted to the inner housing for rotation about a driver axis, wherein the driver axis and the longitudinal axis are non-parallel; and a driven component mounted to the inner housing and engaged with the driver component such that rotation of the driver component about the driver axis causes a corresponding rotation of the driven component about the longitudinal axis;

a bolt mechanism engaged with the driven component such that rotation of the driven component about the longitudinal axis causes a corresponding movement of the bolt mechanism along the longitudinal axis and relative to the inner housing, thereby adjusting a position of the bolt mechanism relative to the inner housing; and a deadlock link mounted to the outer housing for movement between a locked position, in which the deadlock link prevents movement of the inner housing to the retracted position, and an unlocked position, in which the deadlock link permits movement of the inner housing to the extended position.

8. The latch mechanism of claim 7, wherein the bolt mechanism comprises a displacement rod and a latch bolt coupled to an end portion of the displacement rod.

9. The latch mechanism of claim 8, wherein the driven component has a set of internal threads, and wherein the displacement rod has a set of external threads intermeshed with the set of internal threads such that rotation of the driven component about the longitudinal axis causes a corresponding linear movement of the displacement rod along the longitudinal axis.

10. The latch mechanism of claim 9, wherein the driver component is a worm screw and the driven component is a worm gear.

11. The latch mechanism of claim 9, wherein a position of the inner housing relative to the outer housing remains static as the position of the bolt mechanism is adjusted along the longitudinal axis by the rotation of the driven component.

12. The latch mechanism of claim 7, wherein the outer housing is configured for placement within a cavity of the door.

13. The latch mechanism of claim 7, wherein the deadlock link comprises an abutment surface, wherein with the deadlock link in the locked position, the abutment surface blocks movement of the inner housing in a direction of the retracted position.

14. A latch mechanism for a door, the latch mechanism comprising:

an outer housing having an inner region;

an inner housing configured for slidable displacement relative to the outer housing within the inner region;

an adjustment mechanism secured to the inner housing and being slideably displaceable with the inner housing relative to the outer housing, the adjustment mechanism having a driver component and a driven component engaged with the driver component, wherein the driver component is rotatable about a first axis to displace the driven component;

a bolt mechanism engaged with the driven component such that the displacement of the driven component causes a corresponding movement of the bolt mechanism along a second axis, thereby adjusting a position of the bolt mechanism; and a deadlock link movably mounted to the outer housing for movement between a locked position and an unlocked position, wherein the deadlock link in the locked position prevents displacement of the inner housing relative to the outer housing, and wherein the deadlock link in the unlocked position permits displacement of the inner housing relative to the outer housing.

15. The latch mechanism of claim 14, wherein the bolt mechanism comprises a displacement rod and a latch bolt, the displacement rod having a body portion and an end portion, and wherein the latch bolt is secured to the end portion.

16. The latch mechanism of claim 14, wherein the driver component is a worm screw and the driven component is a worm gear.

17. The latch mechanism of claim 15, wherein the driven component includes an aperture having internal threads that mate with external threads of the body portion of the displacement rod, and wherein the displacement of the driven component is a rotational displacement that causes the internal threads to engage the external threads so as to adjust a position of the displacement rod along the second axis, thereby adjusting the position of the bolt mechanism.

18. The latch mechanism of claim 15, wherein the displacement rod and the latch bolt are part of a single-pieces monolithic structure.

19. The latch mechanism of claim 15, wherein the driver component is a pinion and the driven component comprises a plurality of serrations in a sidewall of the displacement rod.

20. The latch mechanism of claim 14, wherein the driver component is a first bevel gear and wherein the driven component is a second bevel gear.

* * * * *